US007234798B2

(12) United States Patent
Sanpei et al.

(10) Patent No.: US 7,234,798 B2
(45) Date of Patent: Jun. 26, 2007

(54) INK JET PRINTER

(75) Inventors: Koichi Sanpei, Kawasaki (JP); Mitsuhiro Mori, Kawasaki (JP); Yoshihiro Watanabe, Fukushima (JP)

(73) Assignee: Fuji Xerox Co., Ltd., Tokyo (JP)

( * ) Notice: Subject to any disclaimer, the term of this patent is extended or adjusted under 35 U.S.C. 154(b) by 262 days.

(21) Appl. No.: 10/519,620

(22) PCT Filed: Aug. 30, 2002

(86) PCT No.: PCT/JP02/08840

§ 371 (c)(1),
(2), (4) Date: Dec. 30, 2004

(87) PCT Pub. No.: WO2004/022344

PCT Pub. Date: Mar. 18, 2004

(65) Prior Publication Data

US 2005/0206692 A1 Sep. 22, 2005

(51) Int. Cl.
*B41J 2/175* (2006.01)
*B41J 2/155* (2006.01)

(52) U.S. Cl. ..... 347/85; 347/42

(58) Field of Classification Search ..... 347/12, 347/13, 20, 29, 40, 42, 50, 58
See application file for complete search history.

(56) References Cited

U.S. PATENT DOCUMENTS

| | | | | |
|---|---|---|---|---|
| 6,464,333 | B1 * | 10/2002 | Scheffelin et al. | 347/42 |
| 6,471,335 | B1 * | 10/2002 | Gelbart | 347/49 |
| 6,502,922 | B2 * | 1/2003 | Kawase et al. | 347/42 |
| 6,508,536 | B1 * | 1/2003 | Beerling et al. | 347/42 |
| 6,508,537 | B2 * | 1/2003 | Yamada et al. | 347/42 |
| 6,543,880 | B1 * | 4/2003 | Akhavain et al. | 347/42 |

FOREIGN PATENT DOCUMENTS

| | | | |
|---|---|---|---|
| JP | 4-358844 | A | 12/1992 |
| JP | 10-95114 | A | 4/1998 |
| JP | 2000-263768 | A | 9/2000 |

* cited by examiner

*Primary Examiner*—Anh T. N. Vo
(74) *Attorney, Agent, or Firm*—Oliff & Berridge, PLC

(57) ABSTRACT

The present invention relates to an ink jet printer provided with a line type ink jet head formed by a plurality of ink jet heads, in which a plurality of ink jet heads are fixed to a plate, and an ink is injected to an ink injected subject from a plurality of ink jet heads in a state in which a plate surface of the plate and the ink injected subject are faced to each other.

6 Claims, 12 Drawing Sheets

INK JET PRINTER

TECHNICAL FIELD

The present invention relates to an ink jet printer.

BACKGROUND ART

An ink jet printer executes a print to a subject to be printed by injecting ink to a subject to be injected the ink from an ink jet head. As specific aspects thereof, a "direct print" which executes the print to a paper by injecting the ink to the paper from the ink jet head, and an "indirect print" which executes the print to the paper by injecting the ink to an intermediate transcription body from the ink jet head and transcribing the ink to the paper from the intermediate transcription body are given as examples.

A normal ink jet printer executes the print to a paper by relative move an ink jet head and the paper (or an intermediate transcription body or the like) in two directions so as to scan the paper (or the intermediate transcription body or the like) with respect to the ink jet head or scan the ink jet head with respect to the paper (or the intermediate transcription body or the like). This is because in the normal ink jet printer, a printing width of the ink jet head is smaller than a printing width of the paper with respect to both of a vertical direction and a horizontal direction of the paper.

On the contrary, a line type ink jet printer executes a print to a paper by relative move an ink jet head and the paper (or an intermediate transcription body or the like) in one direction so as to scan the paper (or the intermediate transcription body or the like) with respect to the ink jet head or scan the ink jet head with respect to the paper (or the intermediate transcription body or the like). This is because in the line type ink jet printer, the printing width of the ink jet head is smaller than the printing width of the paper with respect to only one direction of the vertical direction and the horizontal direction of the paper. In other words, since the printing width of the ink jet head is equal to or more than the printing width of the paper with respect to the other direction, it is not necessary to relatively move the ink jet head and the paper (or the intermediate transcription body or the like) in two directions. The line type ink jet printer is desired to come into practical use in view of a high-speed printing.

An ink jet head of the line type ink jet printer is called as a line type ink jet head. As a method of forming the line type ink jet head, there can be considered a method of forming one line type ink jet head from one long ink jet head. In the case of employing this method, since it is necessary to manufacture a very long ink jet head, there are problems in a work size of the manufacturing apparatus, and a yield ratio at a time of manufacturing. However, since there is no effective countermeasure against these problems at the present time, it is hard to employ this method for the time being.

Accordingly, as a method of forming the line type ink jet head, there can be considered a method of forming one line type ink jet head from a plurality of short ink jet heads. In the case of employing this method, since it is necessary to integrally form the short ink jet heads with each other, there is a problem how the line type ink jet head is designed. There is a possibility that a disadvantage is generated at a time of manufacturing the line type ink jet head and maintaining the line type ink jet head, in accordance with the design.

DISCLOSURE OF THE INVENTION

An object of the present invention (a first invention) is to achieve an ink jet printer provided with a line type ink jet head formed from a plurality of ink jet heads, in which an excellent design is provided.

The invention (the first invention) relates to the ink jet printer provided with a line type ink jet head formed from a plurality of ink jet heads, wherein a plurality of ink jet heads are fixed to a plate, and an ink is injected to an ink injected subject from a plurality of ink jet heads in a state in which a plate surface of the plate and the ink injected subject are faced to each other.

In accordance with the invention (the first invention), it is possible to achieve an ink jet printer having an excellent design, wherein the ink jet printer provided with the line type ink jet head formed by a plurality of ink jet heads.

For example, it is possible to make it easy to attach and detach the ink jet head and position the ink jet head at a time of manufacturing and maintaining the line type ink jet head, by fixing a plurality of ink jet heads to the plate such that a plurality of ink jet heads pass through the plate. For example, it is possible to make the ink receiving subject vertical to the injecting direction of the ink, by fixing a plurality of ink jet heads to the plate such that the ink injecting direction of a plurality of ink jet heads is parallel to the plate surface, thereby making the ink receiving subject vertical to the ink injecting direction. For example, it is possible to make the ink receiving subject parallel to the injection surface of the ink, by fixing a plurality of ink jet heads to the plate such that the ink injection surface of a plurality of ink jet heads is parallel to the plate surface, thereby making the ink receiving subject parallel to the plate surface. As mentioned above, in accordance with the invention (the first invention), it is possible to achieve the ink jet printer having the excellent design.

An object of the invention (a second invention) is to achieve an ink jet printer in which it is easy to attach and detach an ink jet head and position the ink jet head at a time of manufacturing and maintaining the line type ink jet head, in connection with the first invention mentioned above.

The invention (the second invention) relates to an ink jet printer as described in the first invention mentioned above, wherein the ink jet head is fixed to the plate by an adjust plate.

In accordance with the invention (the second invention), in connection with the first invention mentioned above, it is possible to achieve the ink jet printer in which it is easy to attach and detach the ink jet head and position the ink jet head at a time of manufacturing and maintaining the line type ink jet head.

An object of the invention (a third invention) is to achieve an ink jet printer in which a tube for supplying the ink to the ink jet head and/or a cable for sending a signal to the ink jet head does not form an obstacle at a time of manufacturing and maintaining the line type ink jet head, in connection with the first invention mentioned above.

The invention (the third invention) relates to an ink jet printer as described in the first invention mentioned above, wherein a tube for supplying the ink to the ink jet head and/or a cable for sending a signal to the ink jet head is buried in the plate.

In accordance with the invention (the third invention), in connection with the first invention mentioned above, it is possible to achieve the ink jet printer in which the tube for supplying the ink to the ink jet head and/or the cable for sending the signal to the ink jet head does not form the obstacle at a time of manufacturing and maintaining the line type ink jet head.

An object of the invention (a fourth invention) is to achieve an ink jet printer in which it is easy to attach and detach the ink jet head and position the ink jet head at a time of manufacturing and maintaining the line type ink jet head, in connection with the first invention mentioned above.

The invention (the fourth invention) relates to an ink jet printer as described in the first invention mentioned above, wherein tubes for supplying the ink to the ink jet head and/or cables for sending a signal to the ink jet head are respectively connected by a connector.

In accordance with the invention (the fourth invention), in connection with the first invention mentioned above, it is possible to achieve the ink jet printer in which it is easy to attach and detach the ink jet head and position the ink jet head at a time of manufacturing and maintaining the line type ink jet head.

An object of the invention (a fifth invention) is to achieve an ink jet printer in which an ink meniscus of an ink jet head is maintained in a stable state even in the case that a movable plate is moved, in connection with the first invention mentioned above.

The invention (the fifth invention) relates to an ink jet printer as described in the first invention mentioned above, wherein an ink tank for supplying the ink to the ink jet head is fixed to the plate, and a height of an ink liquid surface in the ink tank is controlled such that the height of the ink liquid surface in the ink tank is maintained at a set value with respect to the movable plate.

In accordance with the invention (the fifth invention), in connection with the first invention mentioned above, it is possible to achieve the ink jet printer in which the ink meniscus of the ink jet head is maintained in the stable state even in the case that the movable plate is moved.

BEST MODE FOR CARRYING OUT THE INVENTION

A description will be given of an embodiment in accordance with the present invention with reference to the accompanying drawings.

Figure 1:
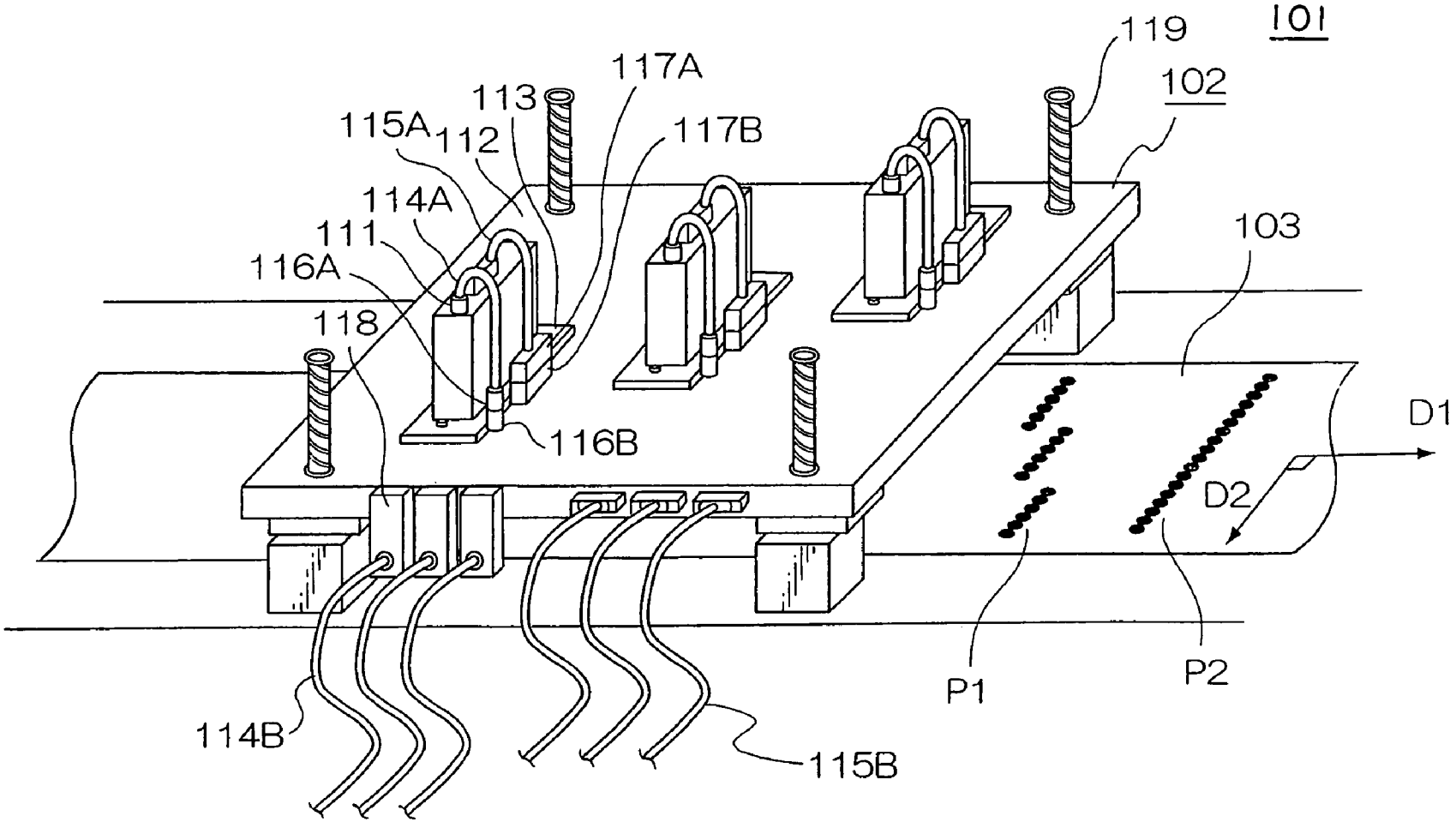
FIG. 1 shows an ink jet printer in accordance with an embodiment of the invention, and specifically shows a state of the ink jet printer at a time of printing.
Figure 2:
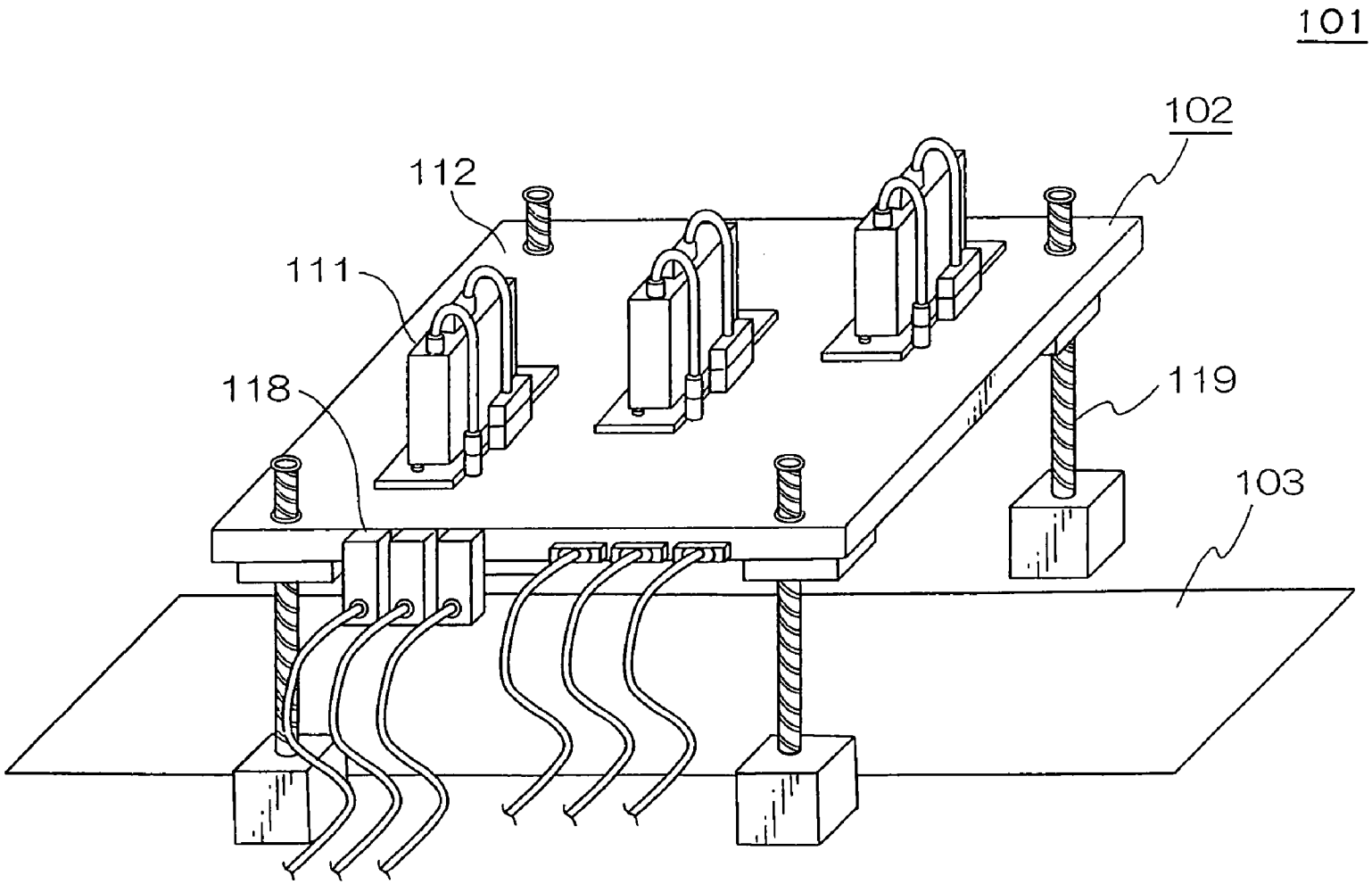
FIG. 2 shows an ink jet printer in accordance with the embodiment of the invention, and specifically shows a state of the ink jet printer at a time of maintenance.

FIGS. 1 and 2 show an ink jet printer 101 in accordance with an embodiment of the invention. Specifically, FIG. 1 shows a state of the ink jet printer 101 at a time of printing, and FIG. 2 shows a state of the ink jet printer 101 at a time of maintenance.

(Ink Jet Printer 101)

The ink jet printer 101 is a line type ink jet printer, and is provided with a line type ink jet head 102. The line type ink jet head 102 is provided with a plurality of ink jet heads 111, a plate 112, adjust plates 113, ink tubes 114, signal cables 115, ink tube connectors 116, signal cable connectors 117, sub ink tanks 118 and ball screws 119.

The ink jet printer 101 injects ink to a paper 103 from the line type ink jet head 102 so as to execute a print to the paper 103. The ink jet printer 101 injects the ink to the paper 103 from the line type ink jet head 102 in a state in which a vertical direction of the paper 103 is in parallel to a direction D1 and a horizontal direction of the paper is in parallel to a direction D2, as shown in FIG. 1.

A printing width of the line type ink jet head 102 is designed so as to be smaller than a printing width of the paper 103 with respect to the vertical direction (the direction D1) of the paper 103, and to be equal to or larger than the printing width of the paper 103 with respect to the horizontal direction (the direction D2) of the paper 103. Accordingly, the ink jet printer 101 executes the print to the paper 103 by relative move the line type ink jet head 102 and the paper 103 in the direction D1. The ink jet printer 101 in accordance with the present embodiment executes the relative movement mentioned above by feeding the paper 103 in the direction D1 in a state in which the line type ink jet head 102 is at a standstill.

(Line Type Ink Jet Head 102)

Figure 3:
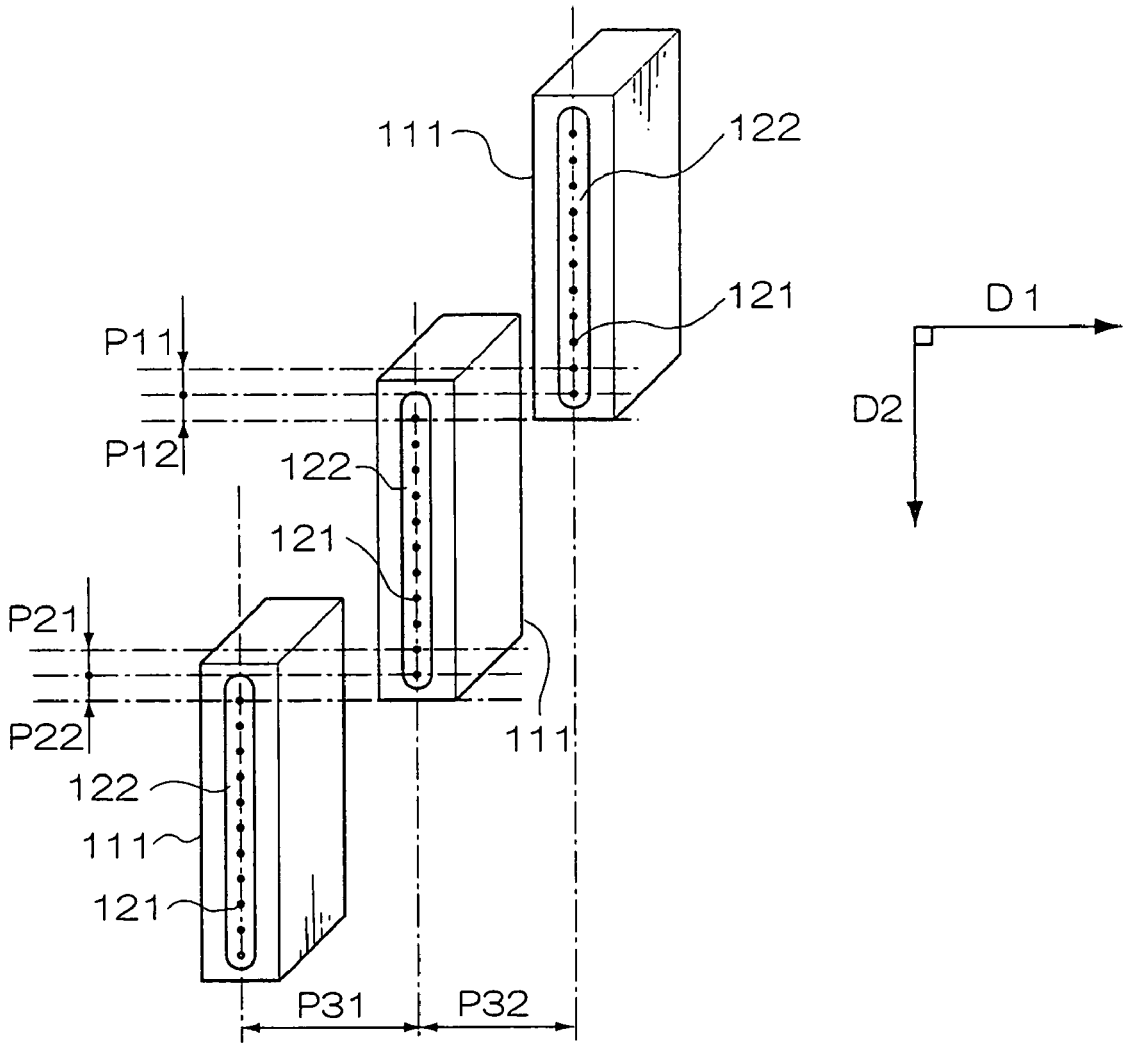
FIG. 3 is a view for explaining a line type ink jet head.

The line type ink jet head 102 is formed by a plurality of (three in this case) ink jet heads 111. FIG. 3 is a view for explaining the line type ink jet head 102. As shown in FIG. 3, each of the ink jet heads 111 is provided with a nozzle line 122 in which a plurality of nozzles 121 are arranged in a line such that a nozzle interval is fixed. In the present embodiment, the ink jet head 111 has a rectangular parallelepiped outer shape, and the nozzle line 122 is provided in a side surface of the ink jet head 111. The side surface corresponds an injection surface of the ink, and a normal direction of the side surface corresponds to an injecting direction of the ink.

Each of the ink jet heads 111 is arranged such that the nozzle line 122 is in parallel to the direction D2. A printing width of each of the ink jet heads 111 in the direction D2, that is, a width of the nozzle line 122 in each of the ink jet heads 111 is smaller than the printing width of the paper 103. A printing P1 in FIG. 1 is a printing obtained by one ink jet head 111.

However, the printing width of the line type ink jet head 102 in the direction D2, that is, a total of the widths of the nozzle lines 122 in the respective ink jet heads 111 becomes equal to or larger than the printing width of the paper 103, by arranging the respective ink jet heads 111 such that the nozzle lines 122 are shifted to each other in the direction D2. A printing P2 in FIG. 1 is a printing obtained by one line type ink jet head 102. In this case, the respective ink jet heads 111 are arranged such that the nozzle interval is fixed, that is, a relation P11=P12 and P21=P22 is established as shown in FIG. 3. Further, for convenience of driving each of the ink jet heads 111, the respective ink jet heads 111 are arranged such that a relation P31=P32 is established.

(Ink Jet Head 111 and Plate 112)

As shown in FIG. 1, in the ink jet printer 101 in accordance with the present embodiment, a plurality of ink jet heads 111 are fixed to a common plate 112. Accordingly, each of the ink jet heads 111 is maintained in a state in which the ink jet head is positioned at the arrangement mentioned above. The plate 112 is formed in a flat outer shape, and has a "plate surface" corresponding to a wide surface and an "end surface" corresponding to a narrow surface. In the present embodiment, since the plate 112 is formed in a rectangular parallelepiped outer shape, the plate 112 has two "plate surfaces" and four "end surfaces".

Further, as shown in FIG. 1, the ink jet printer 101 in accordance with the present embodiment is designed such that the print to the paper 103 is executed by injecting the ink to the paper 103 from a plurality of ink jet heads 111 in a state in which the plate surface of the plate 112 is faced to the paper 103. In this case, the plate surface of the plate 112 and the paper 103 are faced such that the plate surface of the plate 112 and the paper 103 are in parallel to each other. This design is employed for the reason because it is possible to achieve the ink jet printer 101 having an excellent design by employing the design mentioned above.

For example, as shown in FIG. 1, it is possible to make it easy to attach and detach the ink jet head 111 and position the ink jet head 111 at a time of manufacturing and maintaining the line type ink jet head 102, by fixing a plurality of ink jet heads 111 to the plate 112 such that a plurality of ink jet heads 111 pass through the plate 112. In this case, the ink jet heads 111 pass through the plate 112 on the basis of an aspect that the ink injection surfaces of the ink jet heads 111 make an intrusion into the plate surface in a side of the paper 103 from the plate surface in an opposite side to the paper 103.

Further, for example, as shown in FIG. 1, it is possible to make the paper 103 vertical to the injecting direction of the ink, by fixing a plurality of ink jet heads 111 to the plate 112 such that the ink injecting direction of a plurality of ink jet heads 111 is vertical to the plate surface, thereby making the paper 103 parallel to the plate surface. In this case, the ink injecting direction of the ink jet heads 111 is made vertical to the plate surface by fixing the rectangular parallelepiped ink jet heads 111 vertical to the plate surface.

Further, for example, it is possible to make the paper 103 parallel to the injection surface of the ink, by fixing a plurality of ink jet heads 111 to the plate 112 such that the ink injection surface of a plurality of ink jet heads 111 is parallel to the plate surface, thereby making the paper 103 parallel to the plate surface. In this case, the ink injection surface of the ink jet heads 111 is made parallel to the plate surface by fixing the rectangular parallelepiped ink jet heads 111 vertical to the plate surface.

(Adjust Plate 113)

A description will be given of the adjust plate 113 in FIGS. 1 and 2 with reference to FIGS. 4 and 5.

Figure 4:
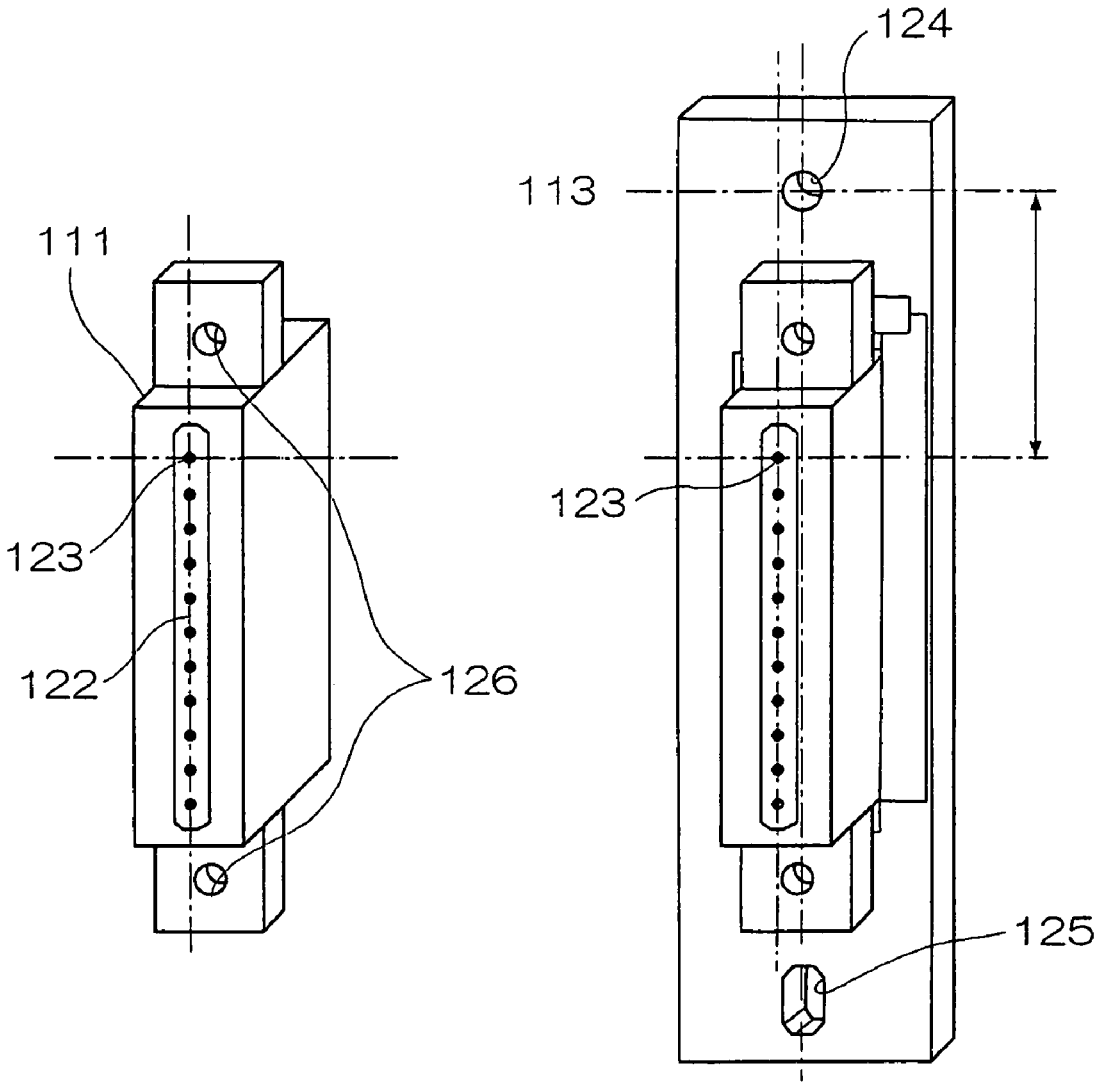
FIG. 4 is a view for explaining an adjust plate.

FIG. 4 shows a state in which the adjust plate 113 is mounted to each of the ink jet heads 111 for fixing each of the ink jet heads 111 under positioned to the plate 112. The ink jet head 111 and the adjust plate 113 are fixed in a fixing portion 126 of the former by an adhesive agent, a resin, a screw, a rivet or the like in a state of adjusting such that a reference nozzle 123 of the former and a main reference hole 124 of the latter are in a preset positional relationship, and the nozzle line 122 of the former is in parallel to a line obtained by connecting the main reference hole 124 and a sub reference hole 125 of the latter. Since the reference nozzle 123 is very small, the adjustment of the positional relationship is manually or automatically carried out by using a device capable of executing an enlarged observation such as an optical microscope, a CCD microscope, a laser microscope and the like.

Figure 5:
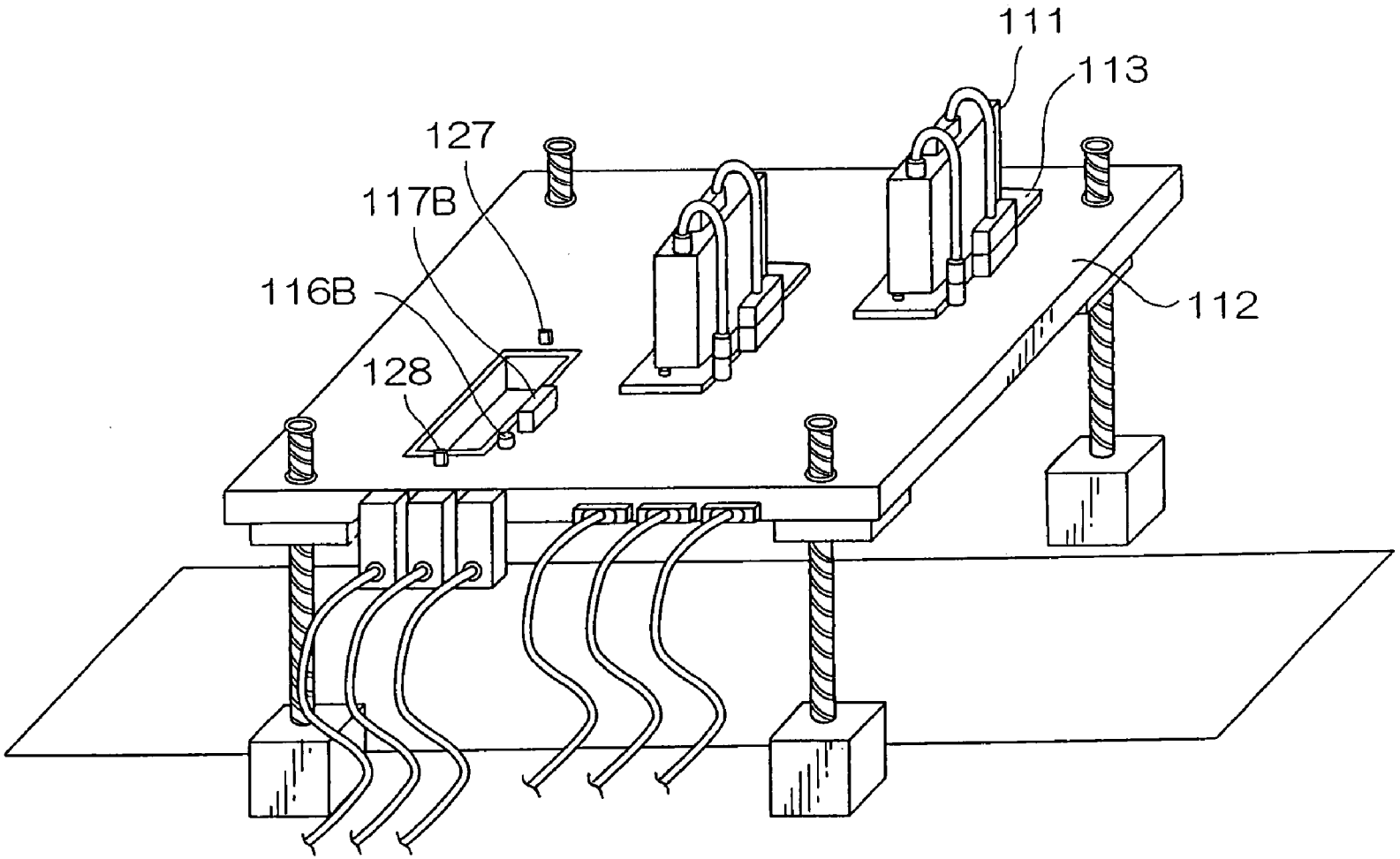
FIG. 5 is a view for explaining the adjust plate.

FIG. 5 shows the ink jet printer 101 in a state in which one ink jet head 111 among three ink jet heads 111 is detached from the plate 112. The ink jet head 111 is mounted and fixed to the plate 112 by fitting the main reference hole 124 and the sub reference hole 125 of the mounted adjust plate 113 to a main reference pin 127 and a sub reference pin 128 provided in the plate 112, respectively. As mentioned above, it is easy to attach and detach the ink jet head 111 and position the ink jet head 111 at a time of manufacturing and maintaining the line type ink jet head 102, by fixing the ink jet head 111 to the plate 112 by the adjust plate 113.

(Ink Tube 114 and Signal Cable 115)

The ink tube 114 in FIGS. 1 and 2 is a tube for supplying the ink to the ink jet head 111, and the signal cable 115 is a cable for sending a signal to the ink jet head 111. The ink is an ink supplied from the ink tank for making the ink jet head 111 to inject, and the signal is a signal (a drive pulse) sent from an ink jet head driver for driving the ink jet head 111.

The ink tube 114 and the signal cable 115 are partly buried in the plate 112. In other words, a portion between an ink tube 114A in a side of the ink jet head 111 and an ink tube 114B in an opposite side to the ink jet head 111, and a portion between a signal cable 115A in a side of the ink jet head 111 and a signal cable 115B in an opposite side to the ink jet head 111 are buried in the plate 112. As mentioned above, since the ink tube 114 and the signal cable 115 are buried in the plate 112, the ink tube 114 and the signal cable 115 do not form an obstacle at a time of manufacturing and maintaining the line type ink jet head 102.

(Ink Tube Connector 116 and Signal Cable Connector 117)

The ink tube connector 116 in FIGS. 1 and 2 is a connector for connecting the ink tubes 114 to each other, and the signal cable connector 117 is a connector for connecting the signal cables 115 to each other.

The ink tube connector 116 and the signal cable connector 117 are respectively provided in a boundary between the ink tube 114A and the signal cable 115A, and the plate 112. One ends 116A and 117A of the ink tube connector 116 and the signal cable connector 117 are respectively mounted to the ink tube 114A and the signal cable 115A, and another ends 116B and 117B of the ink tube connector 116 and the signal cable connector 117 are mounted to the plate 112. The ends 116B and 117B are respectively connected to the ink tube 114B and the signal cable 115B.

If the ink tube connector 116 and the signal cable connector 117 are detached at a time of attaching and detaching the ink jet head 111 and positioning the ink jet head 111, ink tube 114 and the signal cable 115 in the portion which is not buried in the plate 112 do not form the obstacle. As mentioned above, it is possible to easily attach and detach the ink jet head 111 and easily position the ink jet head 111 at a time of manufacturing and maintaining the line type ink jet head 102, by connecting the ink tubes 114 to each other and connecting the signal cables 115 to each other by means of the ink tube connector 116 and the signal cable connector 117.

(Ink Suction)

Figure 6A:
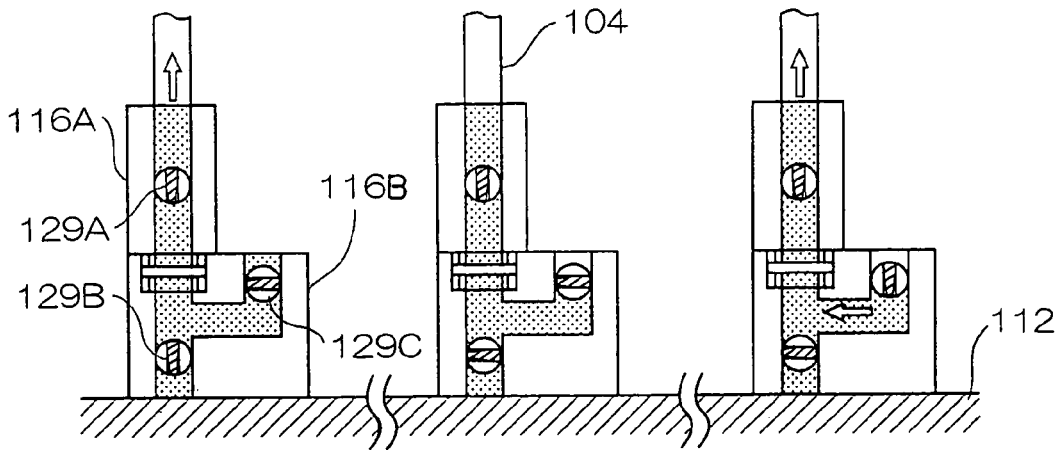
FIG. 6 is a view for explaining ink suction.

A description will be given here of an ink handling at a time of detaching the ink tube connector 116 with reference to FIG. 6. In order to prevent the ink from dripping, it is necessary to previously drain the ink at a time of detaching the ink tube connector 116. Accordingly, the structure is made, as shown in FIG. 6A, such that valves 129A and 129B are respectively provided in the ink tube connectors 116A and 116B, whereby it is possible to shut the ink 104 passing as occasion demands.

Figure 6B:
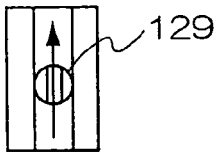
Figure 6C:
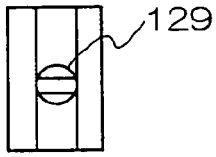
Figure 6D:
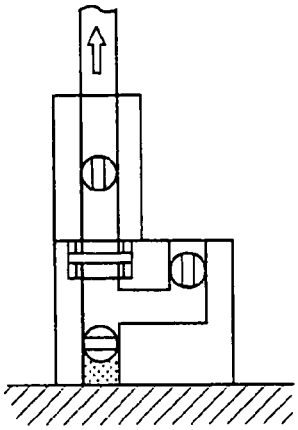
Figure 6E:
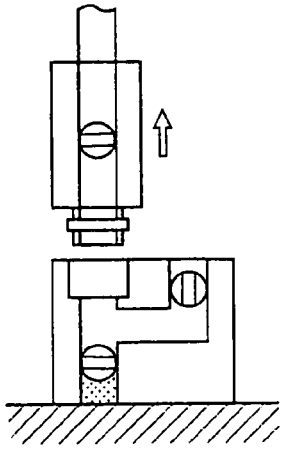

In the case that the valve 129 is set to an "open state" as shown in FIG. 6B, the ink 104 can pass through, and in the case that the valve 129 is set to a "closed state" as shown in FIG. 6C, the ink 104 can not pass through. The valve 129A and the valve 129B are respectively set to the open state and the closed state, as shown in FIG. 6D, the ink 104 is sucked from the nozzle of the ink jet head, and then, the ink tube connector 116 is detached, as shown in FIG. 6E. In this case, as shown in FIG. 6A, the valve 129C serving as an open valve is provided in the ink tube connector 116B, and it is possible to smoothly execute the suction of the ink 104 by setting the valve 129C to the "open state" so as to open to the atmospheric air, at a time of sucking the ink 104, as shown in FIG. 6D.

Figure 6F:
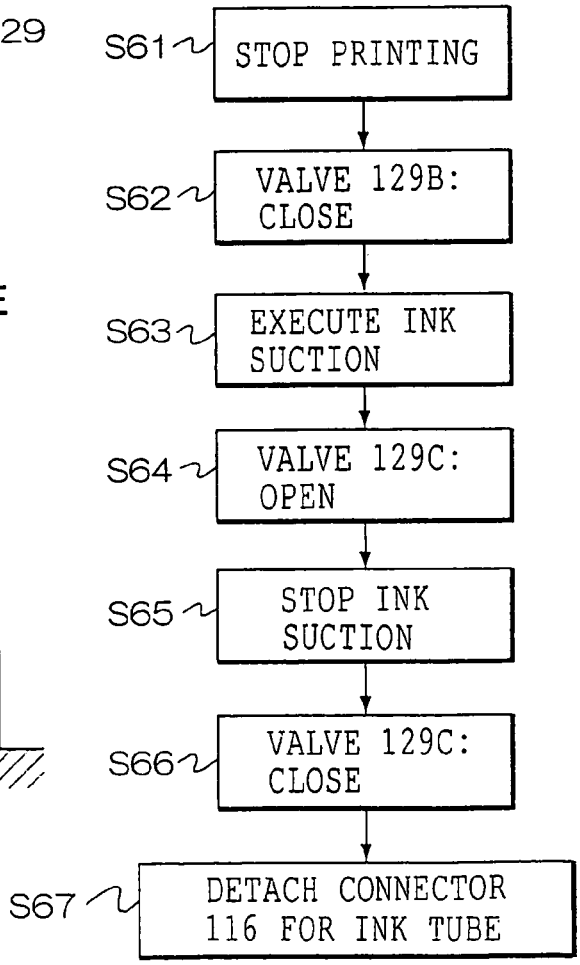

FIG. 6F shows a procedure of the ink suction. The print is stopped (S61), thereafter the valve 129B is set to the closed state (S62), and the ink suction is executed (S63). At this time, the valve 129C is set to the open state (S64). Thereafter, the ink suction is stopped (S65), the valve 129 is set to the closed state (S66), and the ink tube connector 116 is detached (S67).

(Sub Ink Tank 118 and Ball Screw 119)

A description will be given of the sub ink tank 118 and the ball screw 119 shown in FIGS. 1 and 2 with reference to FIGS. 7 to 12. In the case that a trouble such as a clogging or the like is generated in the nozzle of the ink jet head, it is necessary to execute a "nozzle maintenance" such as sucking the ink from the nozzle of the ink jet head so as to remove foreign materials, bubbles, or the like. As mentioned below, at a time of executing the maintenance of the nozzle, it is necessary to insert a maintenance unit for executing the maintenance of the nozzle to a lower portion of the plate. Accordingly, the plate is structured such as to be freely moved in upward and downward directions, and the plate 112 is moved upward at a time of maintaining the nozzle, as shown in FIG. 2. In the present embodiment, the plate 112 moves in the vertical direction by the ball screw 119. In the case of using the other means than the ball screw 119, it is desirable to use a means such as an air cylinder, a hydraulic cylinder, and the like in which an operation accompanies a low impact and a position repeatability is high.

FIG. 7 is a view for explaining the maintenance unit 701. In the ink jet printer in accordance with the present embodiment, since the ink jet head is arranged on the paper-feeding path, it is hard to arrange the maintenance mechanism below the ink jet head.

Figure 7A:
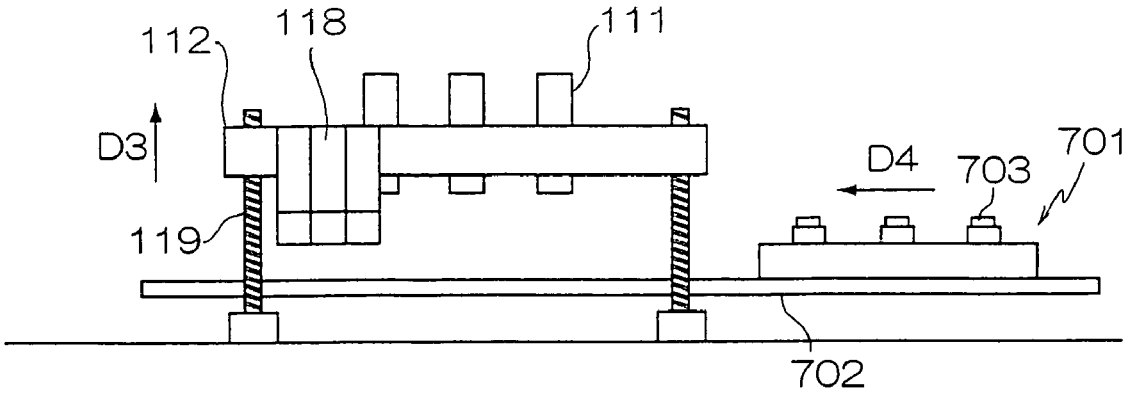
FIG. 7 is a view for explaining a maintenance unit.

Accordingly, as shown in FIG. 7A, the maintenance unit 701 is made to stand ready at a position apart from the plate 112 at a time of printing, and at a time of maintenance, the plate 112 is moved upward in a direction D3, the maintenance unit 701 is moved forward on a guide rail 702 in a direction D4, and the maintenance unit 701 is inserted to the lower portion of the plate 112. The maintenance unit 701 is inserted until a cap 703 of the maintenance unit 701 comes just under the ink jet head 111.

Figure 7B:
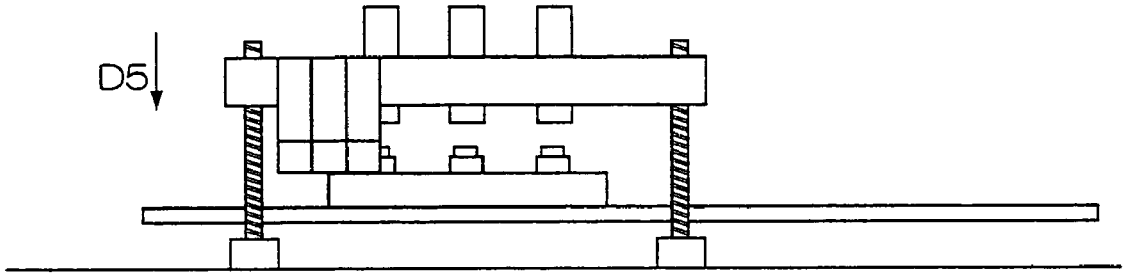
Figure 7C:
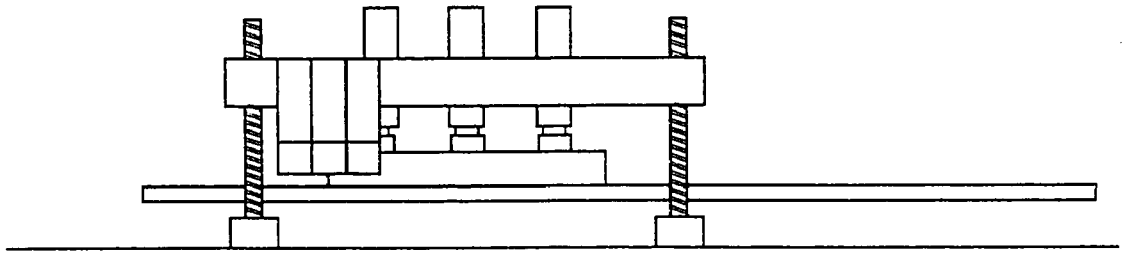

Further, as shown in FIG. 7B, the plate 112 is moved downward in a direction D5, and the cap 703 of the maintenance unit 701 is closely contacted with the ink jet head 111, as shown in FIG. 7C. The inner side of the cap 703 is depressurized by discharging the air within the cap 703 through a tube or the like communicating with the inner side of the cap 703, in this state, and the ink is sucked from the nozzle of the ink jet head 111.

Figure 8:
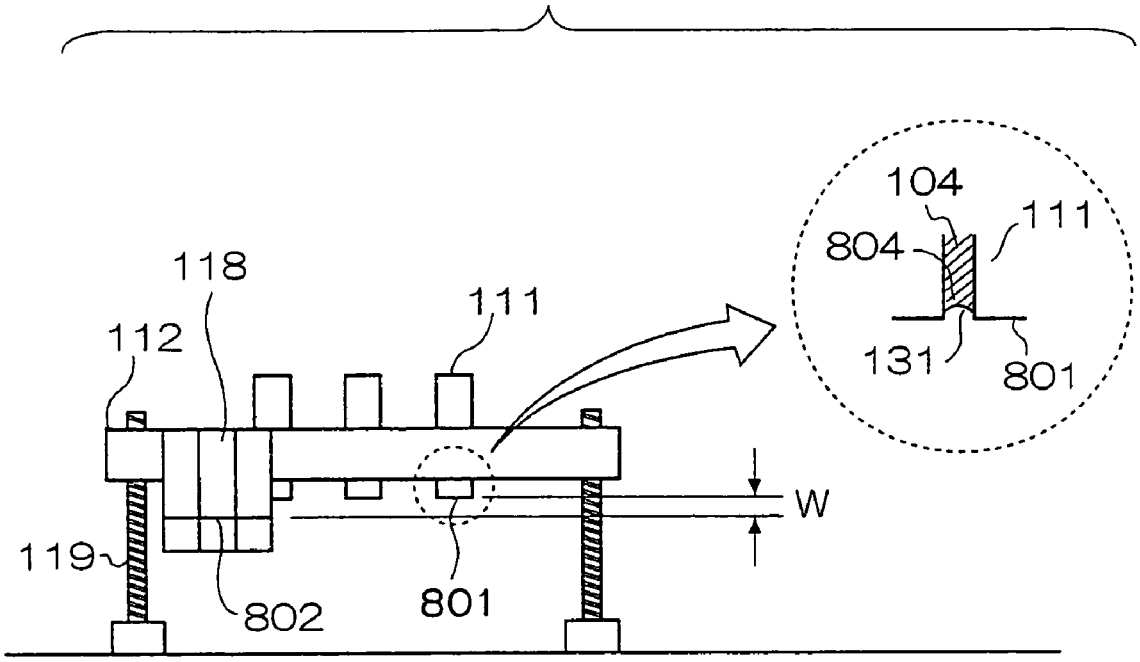
FIG. 8 is a view for explaining a sub ink tank.

FIG. 8 is a view for explaining the sub ink tank 118. In the ink jet printer in accordance with the present embodiment, the structure is made such that the plate 112 can move in the upward and downward directions, as mentioned above. Accordingly, it is necessary to prevent the ink from dripping from an ink injection surface 801 of the ink jet head 111, at a time when the plate 112 moved in the upward and downward directions.

Consequently, in the present embodiment, as shown in FIG. 8, the sub ink tank 118 is fixed to the plate 112, and a height of an ink liquid surface 802 in the sub ink tank 118 is controlled such that the ink injection surface 801 of the ink jet head 111 is higher than the ink liquid surface 802 of the sub ink tank 118. An ink meniscus 804 of the nozzle 131 of the ink jet head 111 is maintained at a negative pressure on the basis of a water head difference W between the ink injection surface 801 and the ink liquid surface 802.

Further, it is possible to keep a state of preventing the bubbles from being sucked into the ink jet head 111 while the ink 104 is not dripped from the nozzle 131 and the ink meniscus 804 is slightly get sucked in the ink jet head 111 from the nozzle 131, by controlling the height of the ink liquid surface 802 such that the water head difference W is maintained at a preset value, in order to maintain the negative pressure at a proper value. As mentioned above, the ink meniscus 804 of the ink jet head 111 can be maintained in the stable state even when the movable plate 112 is moved, by fixing the sub ink tank 802 to the plate 112, and controlling the height of the ink liquid surface 802 of the sub ink tank 118 such that the height of the ink liquid surface 802 of the sub ink tank 118 is maintained at the set value with respect to the movable plate 112.

(Liquid Surface Control)

Figure 9:
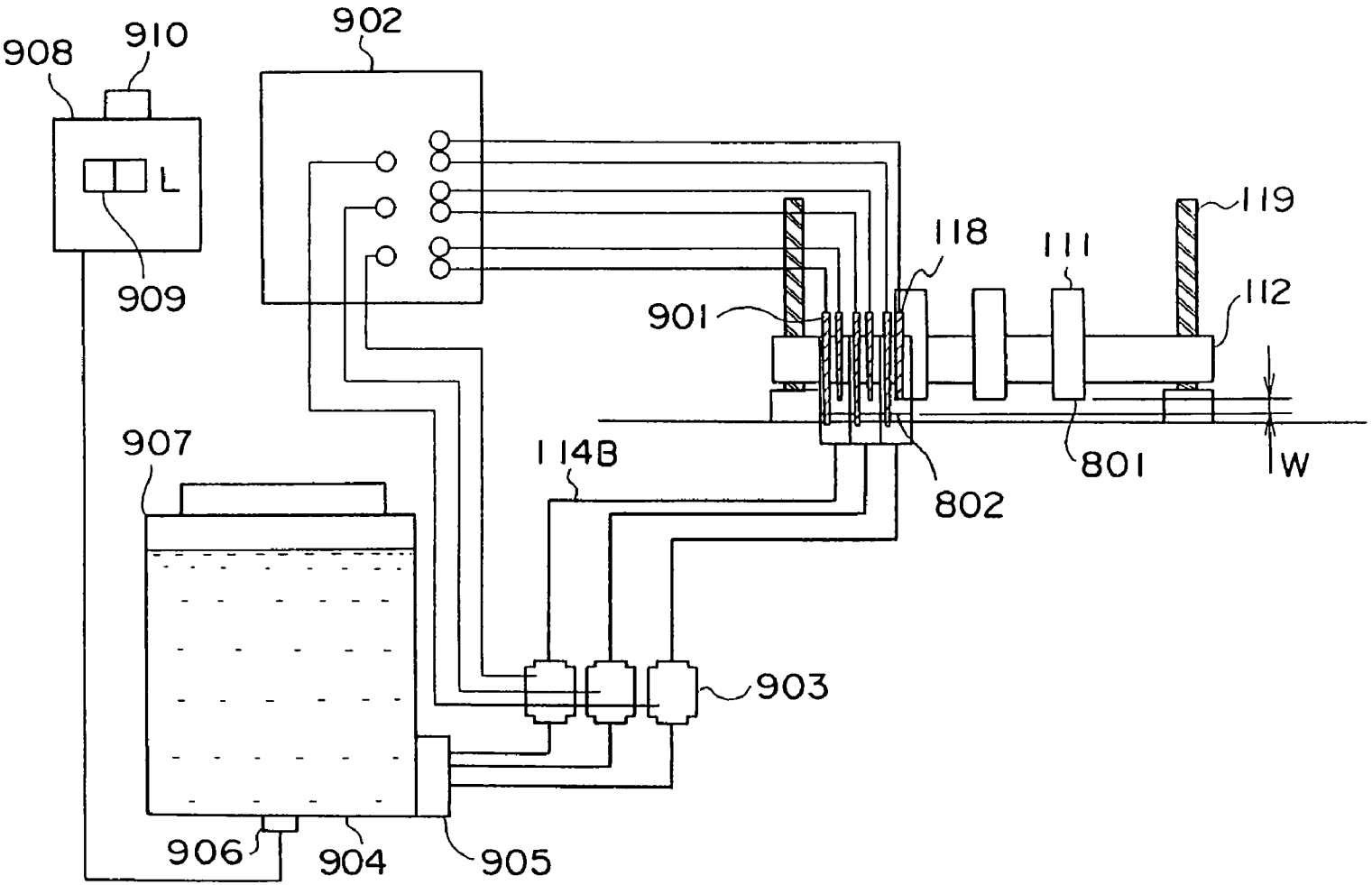
FIG. 9 is a view for explaining a liquid surface control.
Figure 10A:
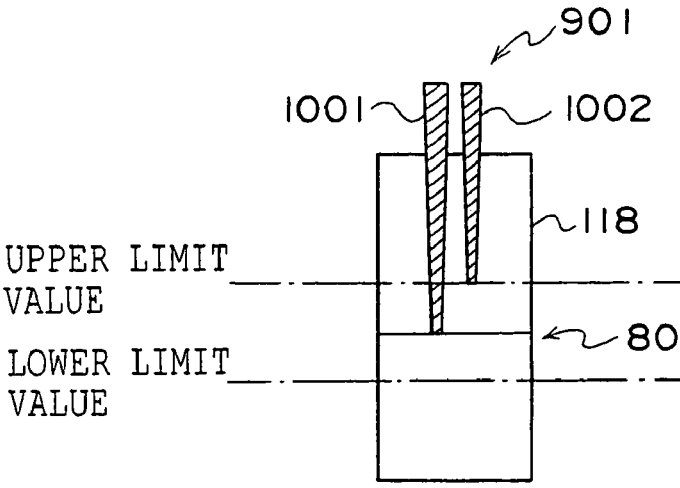
FIG. 10 is a view for explaining a liquid surface control.
Figure 10B:
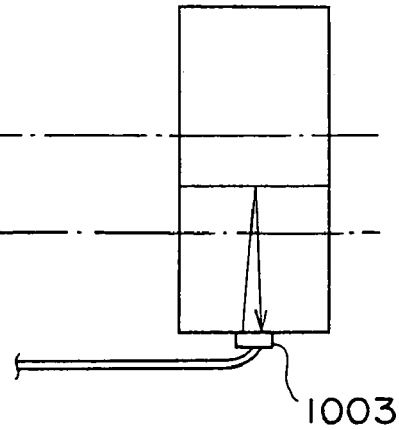

A description will be given here of a method of controlling the height of the ink liquid surface 802 of the sub ink tank 118. The sub ink tank 118 is provided with a liquid surface control sensor 901, as shown in FIG. 9. The liquid surface control sensor 901 is provided with a lower limit detecting portion 1001 and an upper limit-detecting portion 1002, as shown in FIG. 10A. Accordingly, as mentioned below, the set value of the height of the ink liquid surface 802 can be set to a "range from the lower limit value to the upper limit value", and the height of the ink liquid surface 802 can be maintained at the set value. In this case, the liquid surface control sensor 901 may be provided with an ultrasonic sensor 1003, as shown in FIG. 10B.

In the case that the ink is consumed and the height of the ink liquid surface 802 in the sub ink tank 118 reaches the lower limit value, the lower limit detecting portion 1001 detects the matter. When the matter is notified to the liquid surface control apparatus 902 from the liquid surface control sensor 901, the liquid surface control apparatus 902 sends an "operation signal" to a pump 903. When receiving the operation signal, the pump 903 starts operating. Consequently, the ink reserved in a main ink tank 904 is supplied to the sub ink tank 118 through a filter 905.

When the ink is supplied and the height of the ink liquid surface 802 in the sub ink tank 118 reaches the upper limit value, the upper limit detecting portion 1002 detects the matter. When the matter is notified to the liquid surface control apparatus 902 from the liquid surface control sensor 901, the liquid surface control apparatus 902 sends a "stop signal" to the pump 903. When receiving the stop signal, the pump 903 stops.

In addition, a liquid surface control sensor 906 is provided in the main ink tank 904. When a height of an ink liquid surface 907 in the main ink tank 904 reaches the lower limit value, the liquid surface control sensor 906 informs the operator of the matter by means of lightening of a patrol light 910 and a buzzer, at the same time of displaying an ink residual amount on an indicator 909 of an ink residual amount display apparatus 908.

Figure 11:
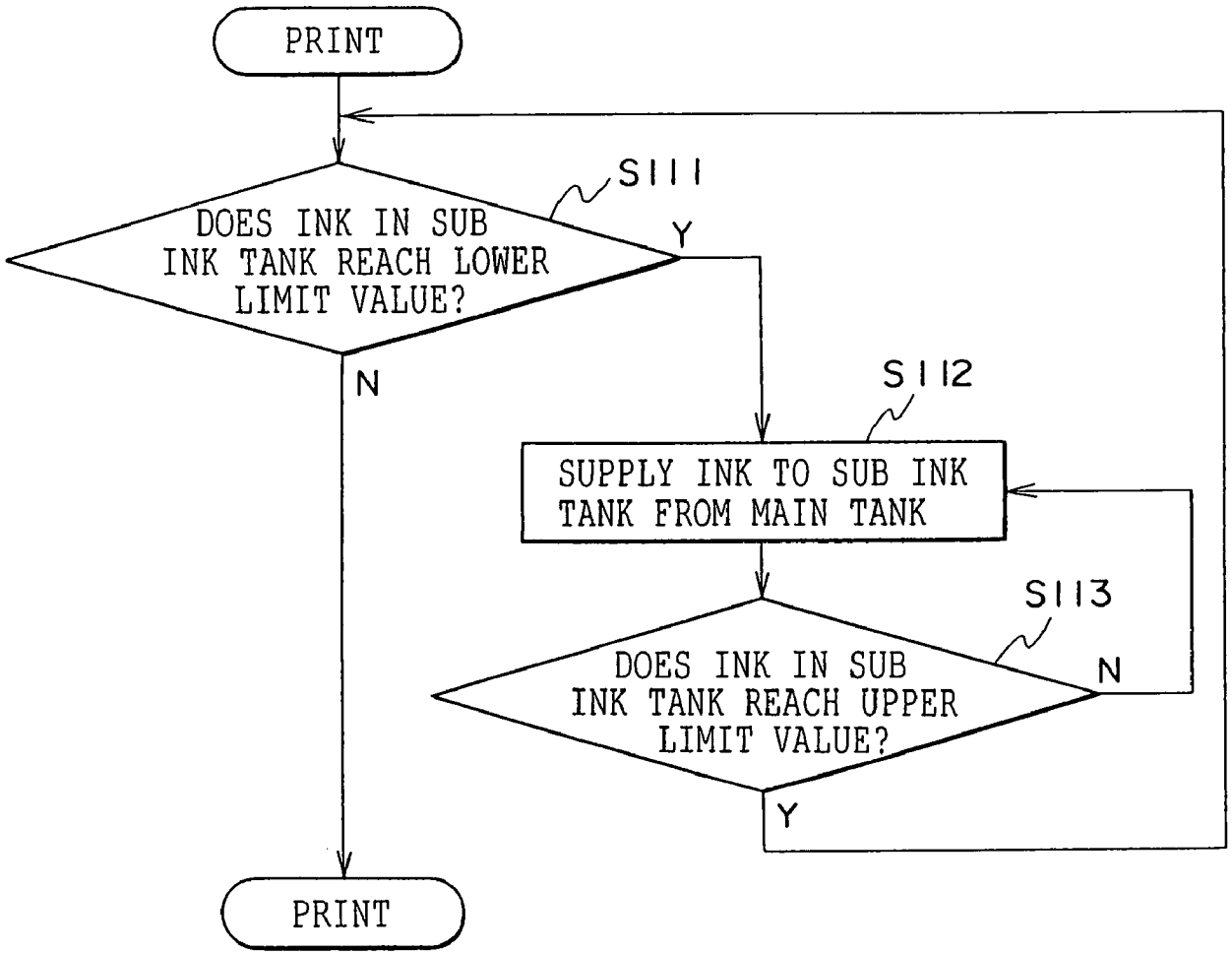
FIG. 11 shows a procedure of a liquid surface control with respect to a sub ink tank.

FIG. 11 shows a procedure of the liquid surface control with respect to the sub ink tank 118. As shown in FIG. 11, when the height of the ink liquid surface 802 in the sub ink tank 118 reaches the lower limit value (S111), the ink supply from the main ink tank 904 to the sub ink tank 118 is started (S112), and the ink supply from the main ink tank 904 to the sub ink tank 118 is continued (S113) until the height of the ink liquid surface 802 in the sub ink tank 118 reaches the upper limit value (S113).

Figure 12:
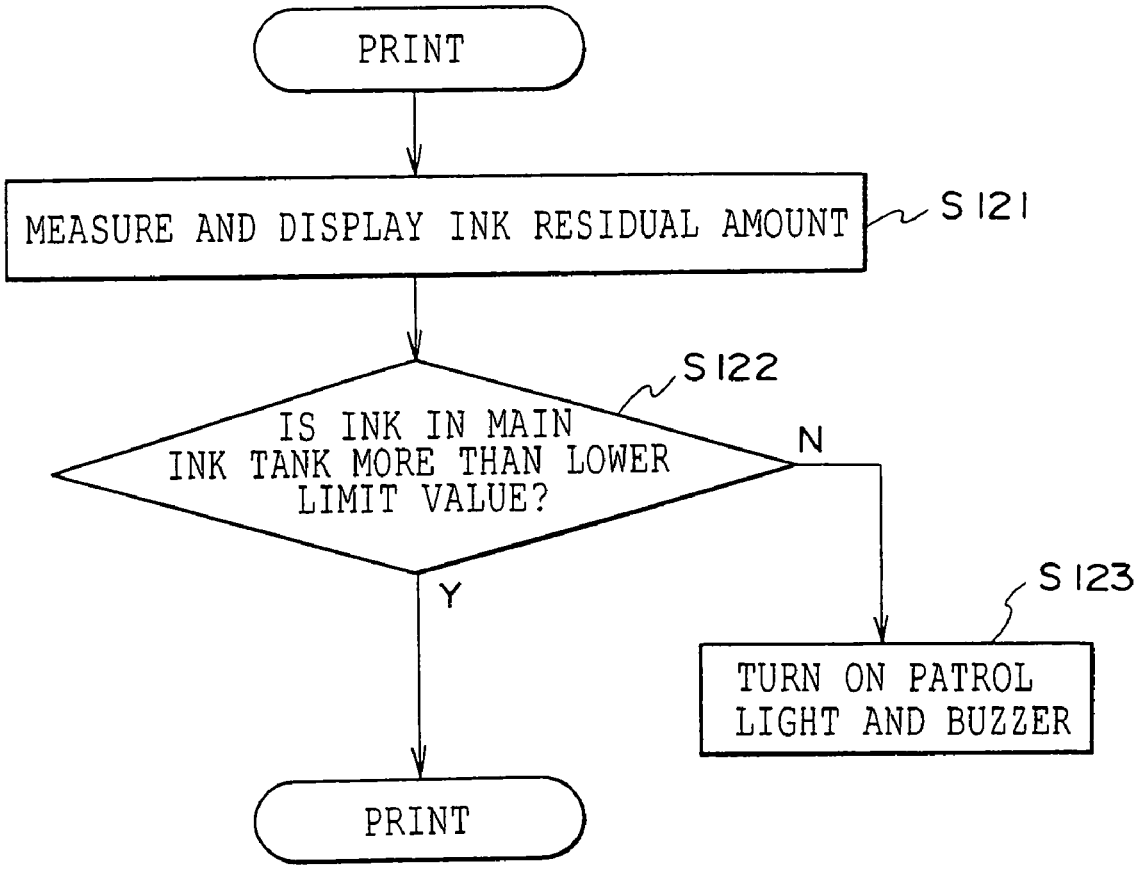
FIG. 12 shows a procedure of a liquid surface control with respect to a main ink tank.

FIG. 12 shows a procedure of the liquid surface control with respect to the main ink tank 904. As shown in FIG. 12, the detection and the display of the ink residual amount is continuously executed (S121), and the patrol light 910 is turned on and the buzzer is sounded (S123), at a time when the height of the ink liquid surface 907 in the main ink tank 904 reaches the lower limit value (S122).

The invention is not limited to the specifically disclosed embodiment, and various modified examples and embodiments can be considered within the claimed scope of the invention.

The invention claimed is:

1. An ink jet printer comprising a line type ink jet head formed by a plurality of ink jet heads, characterized in that the plurality of ink jet heads are fixed to a plate, and an ink is injected to an ink receiving subject from the plurality of ink jet heads in a state in which a plate surface of the plate and the ink receiving subject are faced to each other; and a connector is provided adjacent to the ink jet head on the plate to connect tubes to each other and to connect cables to each other, wherein the tubes are for supplying the ink to the ink jet head and the cables are for sending a signal to the ink jet head.

2. The ink jet printer according to claim 1, characterized in that the ink jet head is fixed to the plate by an adjust plate.

3. The ink jet printer according to claim 1, characterized in that a tube for supplying the ink to the ink jet head and/or a cable for sending a signal to the ink jet head is buried in the plate.

4. The ink jet printer according to claim 1, characterized in that an ink tank for supplying the ink to the ink jet head is fixed to the plate, and a height of an ink liquid surface in the ink tank is controlled such that the height of the ink liquid surface in the ink tank is maintained at a set value with respect to the plate.

5. The ink jet printer according to claim 1, further comprising a drive unit for lifting the plate from the position for printing to execute a nozzle maintenance of the ink jet heads.

6. The ink jet printer according to claim 5, further comprising a maintenance unit having caps and being inserted to the position under the plate for capping the ink jet heads.

* * * * *